US005702804A

United States Patent [19]

Malhotra

[11] Patent Number: 5,702,804

[45] Date of Patent: Dec. 30, 1997

[54] RECORDING SHEETS

[75] Inventor: Shadi L. Malhotra, Mississauga, Canada

[73] Assignee: Xerox Corporation, Stamford, Conn.

[21] Appl. No.: 612,472

[22] Filed: Mar. 7, 1996

[51] Int. Cl.[6] ..... B41M 5/00

[52] U.S. Cl. ..... 428/195; 347/105; 428/211; 428/537.5

[58] Field of Search ..... 428/195, 211, 428/537.5, 411.1; 347/105

[56] References Cited

U.S. PATENT DOCUMENTS

| | | | |
|---|---|---|---|
| 4,446,174 | 5/1984 | Maekawa et al. | 427/261 |
| 4,554,181 | 11/1985 | Cousin et al. | 427/261 |
| 4,740,420 | 4/1988 | Akutsu et al. | 428/341 |
| 4,781,985 | 11/1988 | Desiarlais | 428/421 |
| 4,877,680 | 10/1989 | Sakaki et al. | 428/332 |
| 4,946,741 | 8/1990 | Aono et al. | 428/336 |
| 5,073,448 | 12/1991 | Vieira et al. | 428/331 |
| 5,212,008 | 5/1993 | Maldotra et la. | 428/216 |
| 5,506,085 | 4/1996 | Van Damme et al. | 430/200 |

FOREIGN PATENT DOCUMENTS

| | | |
|---|---|---|
| 924610 | 6/1992 | South Africa . |

*Primary Examiner*—Bruce H. Hess
*Attorney, Agent, or Firm*—Judith L. Byorick

[57] ABSTRACT

Disclosed is a recording sheet which comprises a substrate and an image receiving coating situated on at least one surface of the substrate, said coating containing an additive selected from the group consisting of macrocycles, porphines, and mixtures thereof, said substrate being selected from the group consisting of paper and transparent polymeric materials, said image receiving coating being suitable for receiving images of an aqueous ink.

21 Claims, No Drawings

RECORDING SHEETS

BACKGROUND OF THE INVENTION

The present invention is directed to recording sheets for receiving printed images. More specifically, the present invention is directed to recording sheets particularly suitable for use in ink jet printing processes. One embodiment of the present invention is directed to a recording sheet which comprises a substrate and an image receiving coating situated on at least one surface of the substrate, said coating containing an additive selected from the group consisting of macrocycles, porphines, and mixtures thereof, said image receiving coating being suitable for receiving images of an aqueous ink.

Recording sheets suitable for use in ink jet printing are known. For example, U.S. Pat. No. 4,740,420 (Akutsu et al.) discloses a recording medium for ink jet printing comprising a support material containing at least in the surface portion thereof a water soluble metal salt with the ion valence of the metal thereof being 2 to 4 and a cationic organic material. The cationic organic materials include salts of alkylamines, quaternary ammonium salts, polyamines, and basic latexes.

U.S. Pat. No. 4,446,174 (Maekawa et al.) discloses an ink jet recording method for producing a recorded image on an image receiving sheet with a jet of aqueous ink, wherein an ink jet is projected onto an image receiving sheet comprising a surface layer containing a pigment, and wherein the surface layer is capable of adsorbing a coloring component in the aqueous ink. Poly (vinyl benzyl trimethyl ammonium chloride), poly (diallyl dimethyl ammonium chloride), and poly (methacryloxyethyl-β-hydroxyethyl dimethyl ammonium chloride) are disclosed as dye absorbing adhesive materials.

U.S. Pat. No. 4,554,181 (Cousin et al.) discloses an ink jet recording sheet having a recording surface which includes a combination of a water soluble polyvalent metal salt and a cationic polymer, the polymer having cationic groups which are available in the recording surface for insolubilizing an anionic dye.

U.S. Pat. No. 4,877,680 (Sakaki et al.) discloses a recording medium comprising a substrate and a nonporous ink receiving layer. The ink receiving layer contains a water-insoluble polymer containing a cationic resin. The recording medium may be employed for recording by attaching droplets of a recording liquid thereon.

U.S. Pat. No. 5,212,008 (Malhotra et al.), the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly(aziridine), poly(acrylamide), poly(N,N-dimethyl acrylamide), acrylamide-acrylic acid copolymer, poly(2-acrylamido-2-methyl propane sulfonic acid), poly(N,N-dimethyl-3,5-dimethylene piperidinium chloride), poly (methyleneguanidine)hydrochloride, poly(ethylene imine) poly(ethylene imine)epichlorohydrin, poly(ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly(alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, imidazoline quaternary compounds, alkyl benzyl dimethyl quaternary compounds, poly (epiamines), and mixtures thereof.

U.S. Pat. No. 4,946,741 (Aono et al.) discloses an ink recording sheet comprising a transparent support having thereon an ink recording layer comprising a mixture of an amino group deactivated gelatin derivative and a polyalkylene oxide.

U.S. Pat. No. 4,781,985 (Desjarlais) discloses an ink jet transparency which comprises a substantially transparent resinous support and a substantially clear coating thereon which includes a specific fluorosurfactant.

U.S. Pat. No. 5,073,448 (Vieira et al.) discloses a recording material for ink jet printing comprising a carrier having a surface which can be printed on or a carrier coated on one side with a material which can be printed on, wherein the carrier or the coting contains as a stabilizer at least one compound of the formulaunsubstituted or substituted by one or two

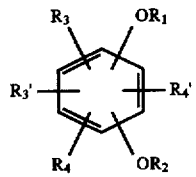

OH, —COO—$M^+$ and/or —$S_3^-M^+$ groups, $C_3$–$C_5$ alkenyl, $C_3$–$C_5$ alkynyl,

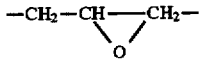

—$CH_2CH(OH)CH_2$—$SO_3$—$M^+$, —CO-alkyl($C_1$–$C_4$) which is unsubstituted or substituted by —$COOR^o$ or —CO—$N(R_5)(R_6)$ or, if $OR_1$ and $OR_2$ are in the ortho position relative to one another, $R_1$ and $R_2$ together are $C_1$–$C_6$ alkylene, $M^+$ being $H^+$, a monovalent, divalent or trivalent metal cation or a group $(R_{12}')N^+(R_{12}'')(R_{13}')(R_{14}')$, wherein $R_{12}'$, $R_{12}''$, $R_{13}$ and $R_{14}$ independently of one another are H, $C_1$–$C_4$ alkyl which is unsubstituted or substituted by 1 or 3 OH, $C_1$–$C_4$ alkyl interrupted by O, allyl, cyclopentyl, cyclohexyl, phenyl, benzyl or tolyl, or $R_1$ is a group

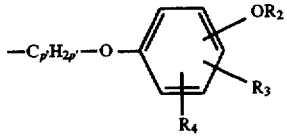

in which p' is a number from 2 to 6, $R_5$ and $R_6$ independently of one another are H or $C_1$–$C_4$ alkyl which is unsubstituted or substituted by an OH, $COOR^o$, —$COO^-M^+$, $SO_3^-M^+$, $P(O)(O^-M^+)_2$ or $P(O)(OR^o)_2$ group, $R_3'$ and $R_4'$ independently of one another are H, $C_1$–$C_4$ alkyl, OH or $C_1$–$C_4$ alkoxy, $R_3$ and $R_4$ independently of one another are H, halogen, —$OR_7$, —$COOR^o$, —$COO^-M^+$, —OOC—$R_5$, —CO—$N(R_5)(R_6)$, —$(R_5)N$—CO—$R_6$, —CO—$R_5$, —$SO_3^-M^+$, —$SO_2N(R_5)(R_6)$, $P(OR_5)_3$, —(O)P—$(O^-M^+)_2$, —(O)P—$(OR^o)_2$, $C_1$–$C_8$ alkyl which is unsubstituted or substituted by 1 to 7 —$OR_5$ or —OO—C—$R_5$ groups, by 1 or 2 —$COOR^o$, —$COO^-M^-$, or —CO—$N(R_5)(R_6)$ groups or by one or two —$SO_3^-M^+$, —$SO_2N(R_5)(R_6)$ or —(O)P—$(OR^o)_2$ or —(O)P$(O^-M^+)_2$ groups, where $M^+$, $R_5$ and $R_6$ are as defined above, or $C_5$–$C_6$ cycloalkyl or allyl, $R^o$ being $C_1$–$C_4$ alkyl which is unsubstituted or substituted by an —OH group or —$(CH_2CH_2O)_r$—H in which r is 1 to 12, and $R_7$ being $C_1$–$C_4$ alkyl or —CO-alkyl($C_1$–$C_4$) each of which is unsubstituted or substituted by 1 or 2 —OH groups or $R_3$ and $R_4$ independently of one another are one of the groups

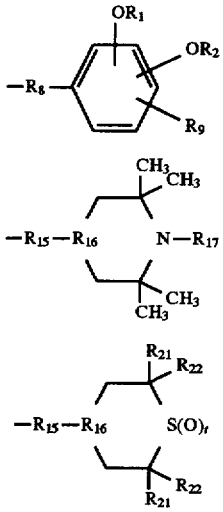

in which $R_8$ is a direct bond or methylene, $R_9$ is H, $C_1$–$C_8$ alkyl, —$COO^-M^+$ or —$SO_3^-M^+$, where $M^+$, $R_1$ and $R_2$ are as defined above, $R_{15}$ is —CO—, —$(O)_g$—$C_pH_{2p}$—CO—, —OOC—$C_pH_{2p}$—, —COO—$C_pH_{2p}$—, —O—$CH_2CH$(OH)—$CH_2$— or

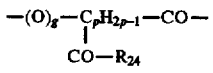

in which g is 0 or 1 and p is 1 to 6 and $R_{24}$ is —$OR_5$, —$N(R_5)(R_6)$ or a group

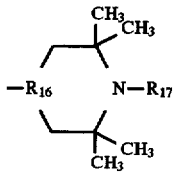

and $R_{16}$ is one of the following radicals:

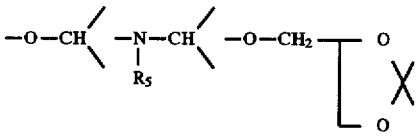

-continued

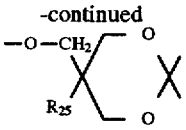

in which $R_{25}$ is H or $C_1$–$C_4$ alkyl, $R_{17}$ is H, $C_1$–$C_4$ alkyl which is unsubstituted or substituted by an —OH group, —$CH_2$—CH(OH)—$CH_2$—OH, $C_1$–$C_4$ alkoxy, —OH, —CO-alkyl($C_1$–$C_4$), —COCH=$CH_2$, allyl, benzyl or a group

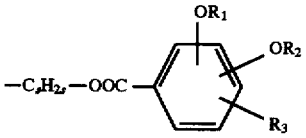

in which s is the number 2 or 3, t is a number from 0 to 2 and $R_{21}$ and $R_{22}$ independently of one another are H, $C_1$–$C_4$ alkyl or phenyl.

South African Patent Application 924,610 discloses a transparent recording sheet suitable for making visual transparencies which comprises a thin transparent film backing bearing on at least one major surface thereof an ink jet receptive layer comprising from 1% to 10% of at least one acid having a pKa of from 2 to 60, said acid being selected from the group consisting of aryl monocarboxylic acids, aryloxy monocarboxylic acids, alkyl carboxylic acids having alkyl groups containing at least 11 carbon atoms, dicarboxylic acids, tricarboxylic acids, and pyridinium salts, and at least one liquid-absorbent polymer comprising from 90% to 99% aprotic constituents, wherein said sheet shows reduced fading when imaged with an ink containing triarylmethane dye and at least one nucleophile over an identical composition containing no protic organic-solvent-soluble additive.

Copending application U.S. Ser. No. 08/034,917, with the named inventors Shadi L. Malhotra, Brent S. Bryant, and Doris K. Weiss, filed Mar. 19, 1993, entitled "Recording Sheets Containing Phosphonium Compounds," the disclosure of which is totally incorporated herein by reference, discloses a recording sheet which comprises a base sheet, a phosphonium compound, an optional pigment, and an optional binder. In a preferred embodiment, the phosphonium compound is selected from the group consisting of

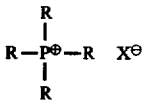

I wherein R is an alkyl group, X is an anion, and all four R groups are the same;

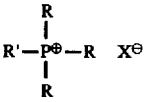

II wherein R is an alkyl group, wherein all three R groups are the same, wherein R is not the same as R', X is an anion, and R' is selected from the group consisting of alkyl groups, substituted alkyl groups, arylalkyl groups, and substituted arylalkyl groups;

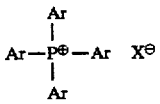

III wherein Ar is an aryl group or a substituted aryl group, X is an anion, and all four Ar groups are the same;

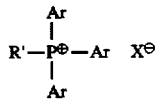

IV wherein Ar is an aryl group or a substituted aryl group, wherein all three Ar groups are the same, X is an anion, and R' is selected from the group consisting of alkyl groups, substituted alkyl groups, arylalkyl groups, and substituted arylalkyl groups; and mixtures thereof.

U.S. Pat. No. 5,314,747 the disclosure of which is totally incorporated herein by reference, discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

U.S. Pat. No. 5,441,795 the disclosure of which is totally incorporated herein by reference, discloses a recording sheet which comprises a base sheet and a material selected from the group consisting of pyridinium compounds, piperazinium compounds, and mixtures thereof.

U.S. Pat. No. 5,320,902 the disclosure of which is totally incorporated herein by reference, discloses a recording sheet which consists essentially of a substrate and, in contact with the substrate, a monoammonium compound of the formula:

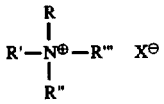

I wherein R is an alkyl group, X is selected from the group consisting of fluoride, chloride, bromide, iodide, and astatide, and R', R", and R'" are each independently selected from the group consisting of alkyl groups, substituted alkyl groups, aryl groups, substituted aryl groups, arylalkyl groups, and substituted arylalkyl groups, wherein R, R', R", and R'" are either the same as or different from each other; and mixtures thereof; an optional binder component; and an optional filler component.

U.S. Pat. No. 5,457,486 the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

U.S. Pat. No. 5,500,668 the disclosure of which is totally incorporated herein by reference, discloses a printing process which comprises (a) providing a recording sheet which comprises a substrate, at least one monomeric salt, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

Copending application U.S. Ser. No. 442,730, with the named inventor Shadi L. Malhotra, entitled "Recording Sheets Containing Alcohols and Saccharides," filed May 17, 1995, and copending application U.S. Ser. No. 08/444,477, with the named inventor Shadi L. Malhotra, entitled "Recording Sheets Containing Alcohols and Saccharides," filed May 19, 1995, the disclosures of each of which are totally incorporated herein by reference, disclose a recording sheet which comprises a substrate and a material selected from the group consisting of monosaccharides, oligosaccharides, and mixtures thereof. Another embodiment of the present invention is directed to a printing process which comprises (a) providing a recording sheet which comprises a substrate, a material selected from the group consisting of monomeric alcohols, monosaccharides, oligosaccharides, and mixtures thereof, an optional binder, an optional antistatic agent, an optional biocide, and an optional filler; (b) applying an aqueous recording liquid to the recording sheet in an imagewise pattern; and (c) thereafter exposing the substrate to microwave radiation, thereby drying the recording liquid on the recording sheet.

U.S. Pat. No. 5,589,277 with the named inventor Shadi L. Malhotra, entitled "Recording Sheets Containing Amino Acids, Hydroxy Acids, and Polycarboxyl Compounds," filed Feb. 15, 1994, and copending application U.S. Ser. No. 08/461,581, with the named inventor Shadi L. Malhotra, entitled "Recording Sheets Containing Amino Acids, Hydroxy Acids, and Polycarboxyl Compounds," filed Jun. 2, 1995, the disclosures of each of which are totally incorporated herein by reference, disclose a recording sheet which comprises a paper substrate and a material selected from the group consisting of monomeric amino acids, monomeric hydroxy acids, monomeric polycarboxyl compounds, and mixtures thereof. Another embodiment of the present invention is directed to a recording sheet which comprises a substrate and an additive material selected from the group consisting of monomeric amino acids, monomeric hydroxy acids, and mixtures thereof.

Copending application U.S. Ser. No. 08/196,607, with the named inventor Shadi L. Malhotra, filed concurrently herewith, entitled "Recording Sheets Containing Amine Salts and Quaternary Choline Halides," filed Feb. 15, 1994, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 08/196,676, with the named inventor Shadi L. Malhotra, entitled "Recording Sheets Containing Pyrrole, Pyrrolidine, Pyridine, Piperidine, Homopiperidine, Quinoline, Isoquinoline, Quinuclidine, Indole, and Indazole Compounds," filed Feb. 15, 1994, and copending application U.S. Ser. No. 08/448,738, with the named inventor Shadi L. Malhotra, entitled "Recording Sheets Containing Pyrrole, Pyrrolidine, Pyridine, Piperidine, Homopiperidine, Quinoline, Isoquinoline, Quinuclidine, Indole, and Indazole Compounds," filed May 24, 1995, the disclosures of each of which are totally incorporated herein by reference, disclose a recording sheet which comprises a substrate and an additive material selected from the group consisting of pyrrole compounds, pyrrolidine compounds, pyridine compounds, piperidine compounds, homopiperidine compounds, quinoline compounds, isoquinoline compounds, quinuclidine compounds, indole compounds, indazole compounds, and mixtures thereof.

Copending application U.S. Ser. No. 08/196,933, with the named inventor Shadi L. Malhotra, entitled "Recording Sheets Containing Purine, Pyrimidine, Benzimidazole, Imidazolidine, Urazole, Pyrazole, Triazole, Benzotriazole, Tetrazole, and Pyrazine Compounds," filed Feb. 15, 1994, and U.S. Pat. No. 5,659,348 the disclosures of each of which are totally incorporated herein by reference, disclose a recording sheet which comprises a substrate and a material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof. Also disclosed is a recording sheet which consists essentially of a substrate, at least one material selected from the group consisting of purine compounds, pyrimidine compounds, benzimidazole compounds, imidazolidine compounds, urazole compounds, pyrazole compounds, triazole compounds, benzotriazole compounds, tetrazole compounds, pyrazine compounds, and mixtures thereof, an optional binder, an optional antistatic agent, an optional biocide, and an optional filler.

Copending application U.S. Ser. No. 08/196,672, with the named inventor Shadi L. Malhotra, entitled "Recording Sheets Containing Oxazole, Isooxazole, Oxazolidinone, Oxazoline Salt, Morpholine, Thiazole, Thiazolidine, Thiadiazole, and Phenothiazine Compounds," filed Feb. 15, 1994, and copending application U.S. Ser. No. 08/455,611, with the named inventor Shadi L. Malhotra, entitled "Recording Sheets Containing Oxazole, Isooxazole, Oxazolidinone, Oxazoline Salt, Morpholine, Thiazole, Thiazolidine, Thiadiazole, and Phenothiazine Compounds," filed May 31, 1995, the disclosures of each of which are totally incorporated herein by reference, disclose a recording sheet which comprises a substrate and a material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof. Also disclosed is a recording sheet which consists essentially of a substrate, at least one material selected from the group consisting of oxazole compounds, isooxazole compounds, oxazolidinone compounds, oxazoline salt compounds, morpholine compounds, thiazole compounds, thiazolidine compounds, thiadiazole compounds, phenothiazine compounds, and mixtures thereof, an optional binder, an optional antistatic agent, an optional biocide, and an optional filler.

U.S. Pat. No. 5,663,004 and copending application U.S. Ser. No. 08/504,266, with the named inventors Shadi L. Malhotra, Brent S. Bryant, and Arthur Y. Jones, entitled "Recording Sheets Containing Mildew Preventing Agents," filed Jul. 19, 1995, the disclosures of each of which are totally incorporated herein by reference, disclose a recording sheet which comprises a substrate, an image receiving coating, and a biocide.

U.S. Pat. No. 5,563,014 the disclosure of which is totally incorporated herein by reference, discloses a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member. Also disclosed is a process which comprises (1) providing a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member; (2) uniformly charging the imaging member; (3) subsequent to step (2), exposing the charged imaging member to activating radiation at a wavelength to which the migration marking material is sensitive; (4) subsequent to step (3), causing the softenable material to soften and enabling a first portion of the migration marking material to migrate through the softenable material toward the substrate in an imagewise pattern while a second portion of the migration marking material remains substantially unmigrated within the softenable layer, wherein subsequent to migration of the first portion of migration marking material, either (a) the first portion of migration marking material contacts the transparentizing agent and the second portion of migration marking material does not contact the transparentizing agent; or (b) the second portion of migration marking material contacts the transparentizing agent and the first portion of migration marking material does not contact the transparentizing agent.

U.S. Pat. No. 5,514,505 the disclosure of which is totally incorporated herein by reference, discloses a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (3) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material.

While known compositions and processes are suitable for their intended purposes, a need remains for improved recording sheets. In addition, there is a need for improved recording sheets suitable for use in ink jet printing processes. Further, a need remains for recording sheets which exhibit rapid drying times when imaged with aqueous inks. Additionally, there is a need for recording sheets which enable precipitation of a dye from a liquid ink onto the sheet surface during printing processes and yield images with enhanced lightfastness. A need also remains for recording sheets which are particularly suitable for use in printing processes wherein the recorded substrates are imaged with liquid inks and dried by exposure to microwave radiation. Further, there is a need for recording sheets coated with a discontinuous, porous film. There is also a need for recording sheets which, subsequent to being imaged with an aqueous ink, exhibit reduced curling.

SUMMARY OF THE INVENTION

It is an object of the present invention to provide recording sheets with the above noted advantages.

It is another object of the present invention to provide recording sheets suitable for use in ink jet printing processes.

It is yet another object of the present invention to provide recording sheets which exhibit rapid drying times when imaged with aqueous inks.

It is still another object of the present invention to provide recording sheets which enable precipitation of a dye from a liquid ink onto the sheet surface during printing processes and yield images with enhanced lightfastness.

Another object of the present invention is to provide recording sheets which are particularly suitable for use in printing processes wherein the recorded substrates are imaged with liquid inks and dried by exposure to microwave radiation.

Yet another object of the present invention is to provide recording sheets coated with a discontinuous, porous film.

Still another object of the present invention is to provide recording sheets which, subsequent to being imaged with an aqueous ink, exhibit reduced curling.

These and other objects of the present invention (or specific embodiments thereof) can be achieved by providing a recording sheet which comprises a substrate and an image receiving coating situated on at least one surface of the substrate, said coating containing an additive selected from the group consisting of macrocycles, porphines, and mixtures thereof, said image receiving coating being suitable for receiving images of an aqueous ink.

DETAILED DESCRIPTION OF THE INVENTION

The recording sheets of the present invention comprise a substrate and at least one macrocycle or porphine additive. Any suitable substrate can be employed. Examples include transparent materials, such as polyester, including Mylar™, available from E. I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI America Incorporated, those prepared from biphenylene, such as Astrel™, available from 3M Company, poly(arylene sulfones), such as those prepared from crosslinked poly (arylene ether Icetone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex®, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J. M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Situated on the substrate of the present invention is a macrocycle or porphine additive. Preferably, this additive component is monomeric or nonpolymeric.

Macrocyclic molecules are well Ionown. Macrocycles are discussed in references such as, for example, *Comprehensive Polymer Science* (first supplement), S. Aggarwal and S. Russo, eds., Pergamon Press (Oxford 1992), pp. 107 et seq., *Textbook of Polymer Science, 3rd Edition*, F. Billmeyer, John Wiley & Sons (New York 1984), pp. 139 et seq., and *Encyclopedia of Polymer Science and Engineering*, vol. 9 (John Wiley & Sons (New York 1980), pp. 183 et seq., the disclosures of each of which are totally incorporated herein by reference. Examples of suitable macrocycles include those of the general formula

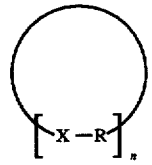

wherein n is an integer of from 3 to 20, and preferably is an integer of from 3 to 10, wherein each X, independently of the others, can be an oxygen atom (—O—), a sulfur atom (—S—), or an amine group (—NQ— group), wherein Q can be (but is not limited to) hydrogen atoms, alicyl groups, preferably with from 1 to about 15 carbon atoms, substituted alicyl groups, preferably with from 1 to about 15 carbon atoms, aryl groups, preferably with from about 6 to about 15 carbon atoms, substituted aryl groups, preferably with from about 6 to about 15 carbon atoms, arylalicyl groups, preferably with from about 7 to about 16 carbon atoms, substituted arylalicyl groups, preferably with from about 7 to about 16 carbon atoms, hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like), and wherein each R, independently of the others, is an alkylene group or a substituted alkylene group with two, three, four, or five carbon atoms as follows:

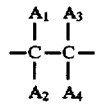

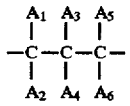

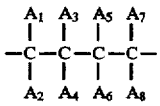

or

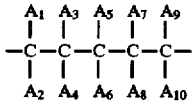

wherein $A_1$, $A_2$, $A_3$, $A_4$, $A_5$, $A_6$, $A_7$, $A_8$, $A_9$, and $A_{10}$ each, independently of the others, can be (but are not limited to) hydrogen atoms, alkyl groups, preferably with from 1 to about 15 carbon atoms, substituted alkyl groups, preferably with from 1 to about 15 carbon atoms, aryl groups, preferably with from about 6 to about 15 carbon atoms, substituted aryl groups, preferably with from about 6 to about 15 carbon atoms, arylalkyl groups, preferably with from about 7 to about 16 carbon atoms, substituted arylalkyl groups, preferably with from about 7 to about 16 carbon atoms, hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of Q, $A_1$, $A_2$, $A_3$, $A_4$, $A_5$, $A_6$, $A_7$, $A_8$, $A_9$, and $A_{10}$ can be joined together to form a ring, and wherein double bonds may exist between ring carbon atoms and atoms in Q, $A_1$, $A_2$, $A_3$, $A_4$, $A_5$, $A_6$, $A_7$, $A_8$, $A_9$, and $A_{10}$, such as carbon, oxygen, sulfur, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

For example, when n is 3, the general formula is

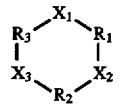

and when n is 4, the general formula is

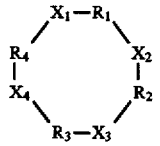

The macrocyclic additive can be a crown, wherein the molecule contains a single central ring, a cryptand, wherein the molecule is bicyclic, or the like. Suitable macrocycles include crown ethers, oxa-cryptands, oxa-aza crown ethers, oxa-aza cryptands, aza crown ethers, aza cryptands, thia crown ethers, thia cryptands, oxa-thia crown ethers, oxa-thia cryptands, aza-thia crown ethers, aza-thia cryptands, oxa-aza-thia crown ethers, oxa-aza-thia cryptands, and the like.

Specific examples of suitable additive materials include (1) cyclic polyethers (crown ethers and oxygen-containing cryptands), wherein X is an oxygen atom, including (A) those wherein n is 4, such as (1) 1,4,7,10-tetraoxacyclododecane (12-crown-4) (Aldrich 19,490-5), of the formula

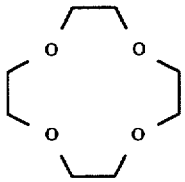

(2) 2-(hydroxyethyl)-12-crown-4 (Aldrich 38,265-5), of the formula

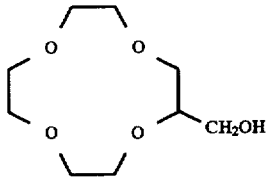

(3) 2-(aminoethyl)-12-crown-4 (Aldrich 38,840-8), of the formula

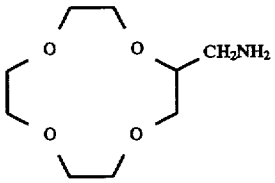

(4) benzo-12-crown-4 (Aldrich 34,775-2), of the formula

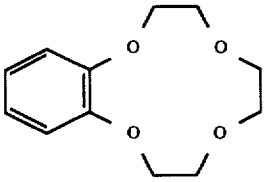

and the like; (b) those wherein n is 5, such as (5) 1,4,7,10,13-pentaoxacyclododecane (15-crown-5) (Aldrich 18,883-2), of the formula

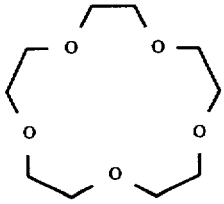

(6) 2-(hydroxymethyl)-15-crown-5 (Aldrich 38,842-4), of the formula

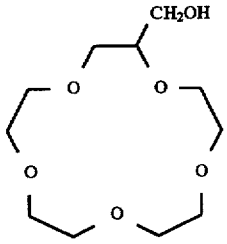

(7) 2-(aminoethyl)-15-crown-5 (Aldrich 38,841-6), of the formula

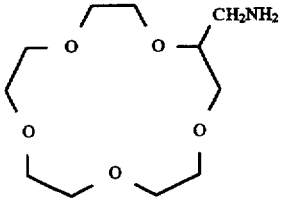

(8) benzo-15-crown-5 (Aldrich 28,279-0), of the formula

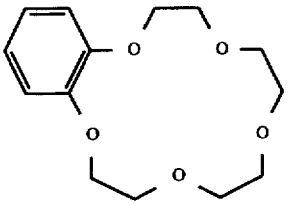

(9) 4'-aminobenzo-15-crown-5 (Aldrich 39,342-8), of the formula

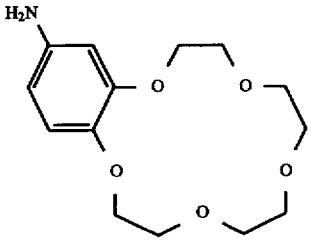

(10) 4'-formylbenzo-15-crown-5 (Aldrich 41,997-4), of the formula

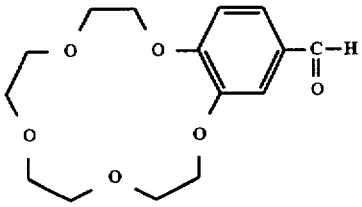

(11) 4'-nitrobenzo-15-crown-5 (Aldrich 34,187-0), of the formula

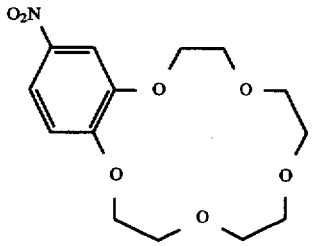

(12) bis[(benzo-15-crown-5)-15-ylmethyl]pimelate (Aldrich 28,430 0), of the formula

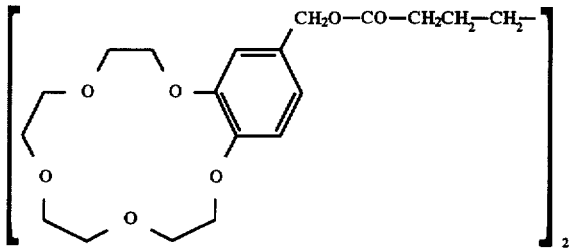

and the like; (c) those wherein n is 6, such as (13) 1,4,7,10,13,16-hexaoxacyclooctadecane (18-crown-6) (Aldrich 18,665-1), of the formula

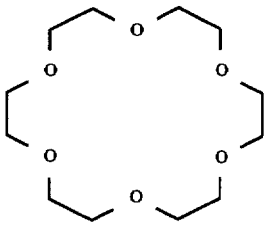

(14) 2-(aminoethyl)-18 crown-6 (Aldrich 38,843-2), of the formula

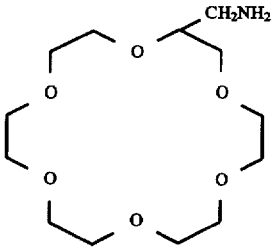

(15) benzo-18 crown-6 (Aldrich 37,229-3), of the formula

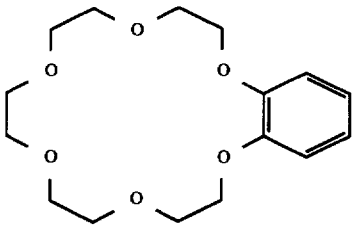

(16) 4'-bromobenzo-18-crown-6 (Aldrich 39,918-3), of the formula

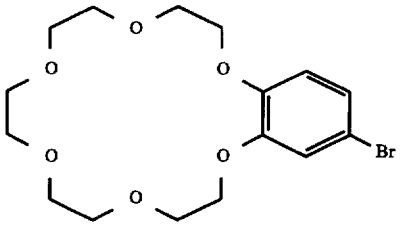

(17) dibenzo-18-crown-6 (2,3,11,12-dibenzo-1,4,7,10,13,16-hexaoxacyclooctadeca-2,11-diene) (Aldrich 15,839-9), of the formula

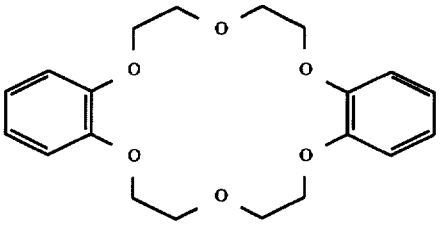

(18) di-tert-butyldibenzo-18-crown-6 (Aldrich 39,644-3), of the formula

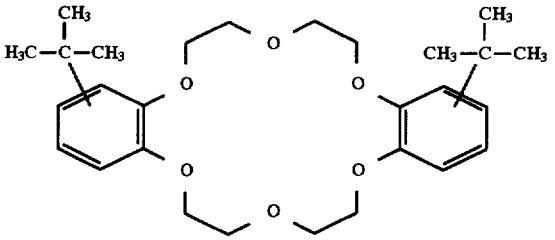

(19) cis-dicyclohexane-18 crown-6 (2,3,11,12-dicyclohexano-1,4,7,10,13,16-hexaoxacyclooctadecane) (Aldrich 15,840-2), of the formula

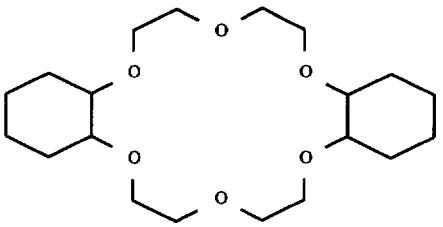

and the like; (d) those wherein n is 8, such as (20) dibenzo-24-crown-8[2,3,14,15-dibenzo-1,4,7,10,13,16,19,22-octaoxacyclotetracosa-2,14-diene] (Aldrich 25,319-7), of the formula

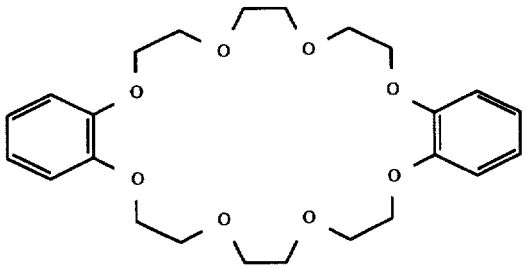

(21) dicyclohexano-24-crown-8 (Aldrich 22,623-8), of the formula

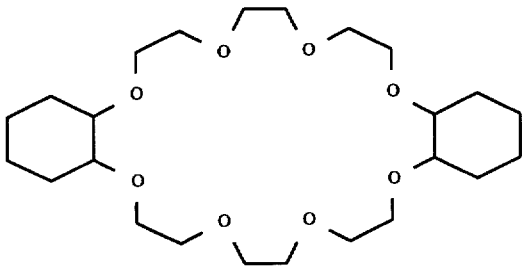

and the like; (e) those wherein n is 10, such as (22) dibenzo-30-crown-10[2,3,17,18-dibenzo-1,4,7,10,13,16,19,22,25,28-decaoxacyclotriaconta-2,17-diene] (Aldrich 33,251-8), of the formula

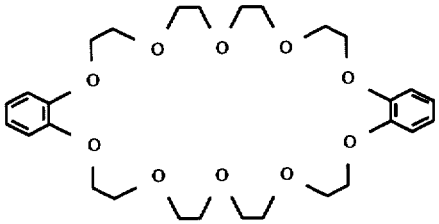

and the like; (2) cyclic poly hetero ethers (oxygen- and nitrogen-containing crowns and cryptands), wherein X is either an oxygen atom or an amine group, including (A) those wherein n is 4, such as (1) 1-aza-12-crown-4 (Aldrich 36,408-8), of the formula

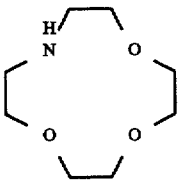

and the like; (B) those wherein n is 5, such as (2) 1-aza-15-crown-5 (Aldrich 36,409-6), of the formula

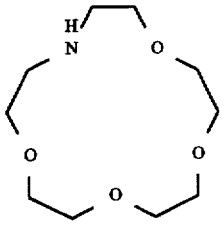

(3) 1,4,10-trioxa-7,13-diazacyclopentadecane (Aldrich 30,732-7), of the formula

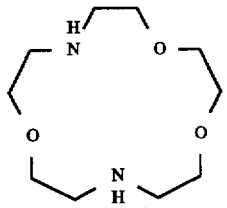

(4) 4,7,13,18-tetraoxa-1,10-diazabicyclo[8.5.5]eicosane (Aldrich 30,733-5), of the formula

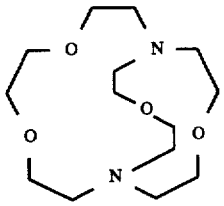

(5) 4,7,13,16,21-pentaoxa-1,10-diazabicyclo[8.5.5]tricosane (Aldrich 29,116-1), of the formula

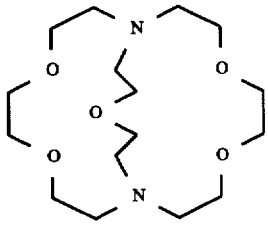

and the like; (B) those wherein n is 6, such as (6) 1-aza-18-crown-6 (Aldrich 36,411-8), of the formula

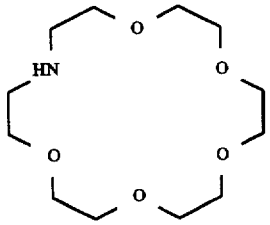

(7) 1,4,10,13-tetraoxa-7,16-diazacyclooctadecane (Aldrich 29,580-9), of the formula

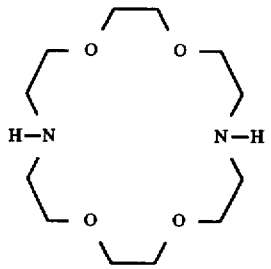

(8) N,N'-dibenzyl-1,4,10,13-tetraoxa-7,16-diazacyclooctadecane (Aldrich 29,472-1), of the formula

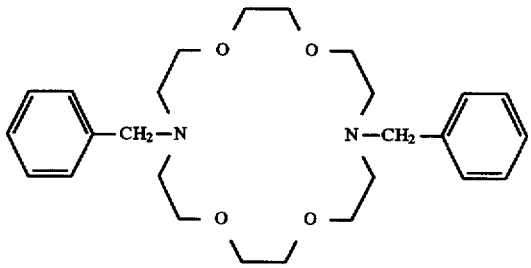

(9) 4,7,13,16,21,24-hexaoxa-1,10-diazabicyclo[8.8.8] hexacosane (Aldrich 29,111-0), of the formula

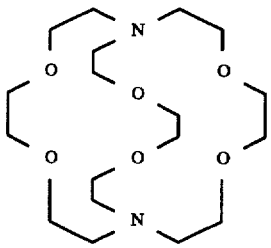

(10) 5,6-benzo-4,17,13,16,21,24-hexaoxa-1,10-diazabicyclo[8.8.8]hexacosane (Aldrich 30,857-9), of the formula

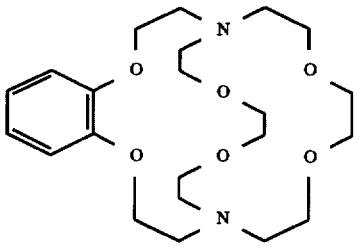

and the like;

(3) cyclic aza-ethers (aza crown ethers and aza cryptands), wherein X is an amine group, including (A) those wherein n is 3, such as (1) 1,4,7-triazacyclononane (Aldrich 31,130-8), of the formula

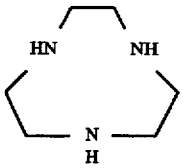

(2) 1,5,9-triazacyclododecane (Aldrich 31,979-1), of the formula

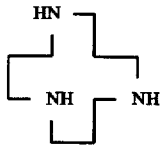

and the like; (B) those wherein n is 4, such as (3) cyclen (1,4,7,10-tetraazacyclododecane) (Aldrich 33,965-2), of the formula

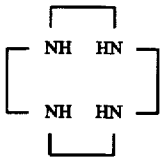

(4) 1,4,8,11-tetraazacyclotetradecane (Aldrich 25,916-0), of the formula

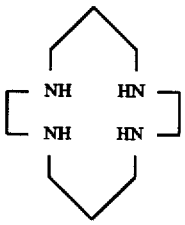

(5) 1,4,8,11-tetramethyl-1,4,8,11-tetraazacyclotetradecane (Aldrich 28,280-4), of the formula

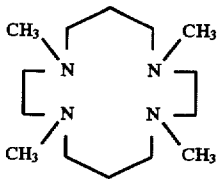

(6) 1,4,8,11-tetraazacyclotetradecane-5,7-dione (Aldrich 33,316-6), of the formula

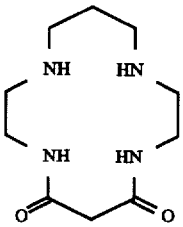

(7) 1,4,8,12-tetraazacyclopentadecane (Aldrich 25,915-2), of the formula

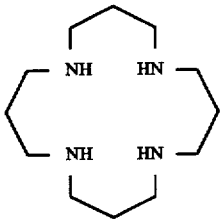

and the like; (C) those wherein n is 6, such as (8) hexacyclen trisulfate (Aldrich 19,393-3), of the formula

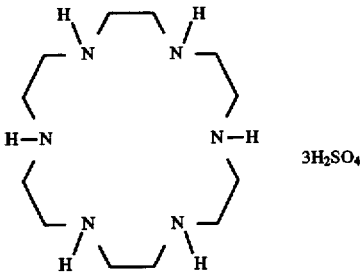

(9) hexamethylhexacyclen[1,4,7,10,13,16-hexamethyl-1,4,7,10,13-16-hexaazacyclooctadecane] (Aldrich 34,903-8), of the formula

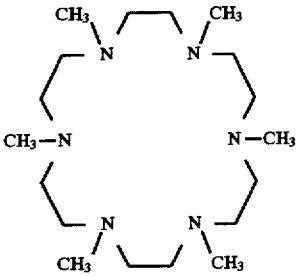

and the like; (4) cyclic poly thia ethers (thia crown ethers and thia cryptands), wherein X is a sulfur atom, including (A) those wherein n is 3, such as (1) 1,4,7-trithiacyclodecane (Aldrich 33,139-2), of the formula

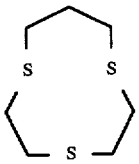

(2) 1,4,7-trithiacyclononane (Aldrich 30,080-2), of the formula

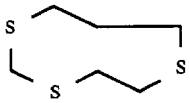

and the like; (B) those wherein n is 4, such as (3) 1,4,7,10-tetrathiacyclododecane (Aldrich 28,136-0), of the formula

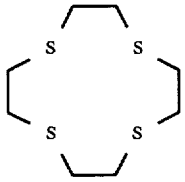

(4) 3,6,9,14-tetrathiabicyclo[9.2.1]tetradeca-11,13-diene (Aldrich 36,140-2), of the formula

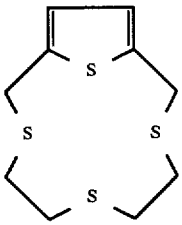

(5) 1,4,8,1-tetrathiacyclotetradecane (Aldrich 25,072-4), of the formula

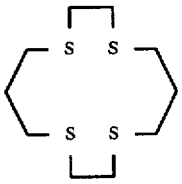

(6) 1,5,9,13-tetrathiocyclohexadecane (Aldrich 28,129-8), of the formula

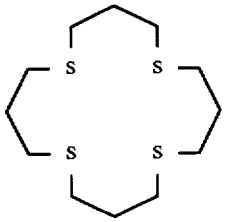

(7) 1,5,9,13-tetrathiacyclohexadecane-3,11-diol (Aldrich 25,823-7), of the formula

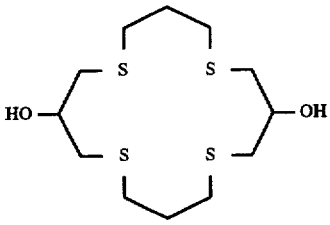

and the like; (C) those wherein n is 5, such as (8) 1,4,7,10,13-pentathiacyclopentadecane (Aldrich 28,134-4), of the formula

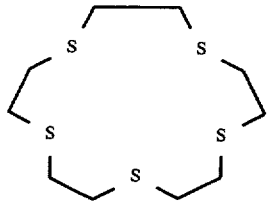

and the like; (D) those wherein n is 6, such as (9) 1,4,7,10,13,16-hexathiacyclooctadecane (Aldrich 28,127-1), of the formula

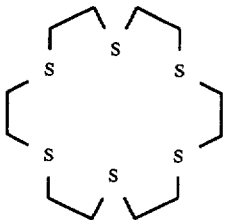

(10) 1,5,9,13,17,21-hexathiacyclotetracosane-3,11,19-triol (Aldrich 26,842-9), of the formula

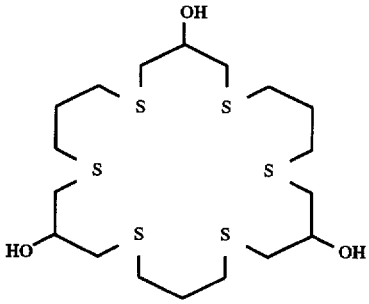

and the like; (E) those wherein n is 8, such as (11) 1,4,7,10,13,16,19,22-octathiacyclotetracosane (Aldrich 28,137-9), of the formula

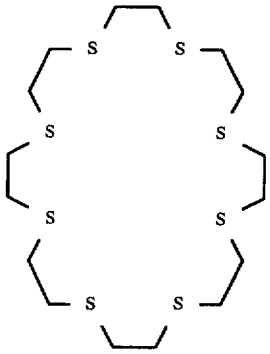

(12) 1,4,8,11,15,18,22,25-octathiacyclooctacosane (Aldrich 36,702-8), of the formula

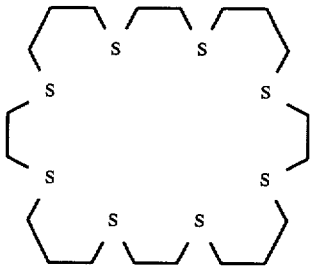

(13) 1,4,7,10,13,16,19,22,25-nonathiacycloheptacosane (Aldrich 41,549-9), of the formula

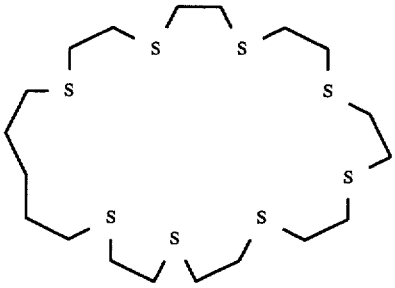

and the like.

Also suitable as additives are porphines, including those of the general formula

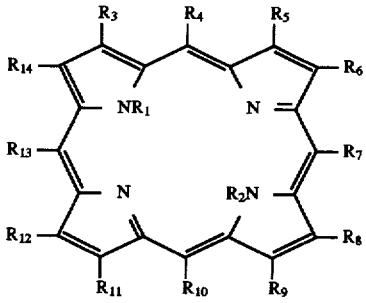

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, can be (but are not limited to) hydrogen atoms, alkyl groups, preferably with from 1 to about 15 carbon atoms and more preferably with from 1 to about 10 carbon atoms, substituted alkyl groups, preferably with from 1 to about 15 carbon atoms and more preferably with from 1 to about 10 carbon atoms, aryl groups, preferably with from 6 to about 15 carbon atoms and more preferably with from about 6 to about 10 carbon atoms, substituted aryl groups, preferably with from 6 to about 15 carbon atoms and more preferably with from 6 to about 10 carbon atoms, arylalkyl groups, preferably with from 7 to about 15 carbon atoms and more preferably with from 7 to about 10 carbon atoms, substituted arylalkyl groups, preferably with from 7 to about 15 carbon atoms and more preferably with from 7 to about 12 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfide groups, sulfoxide groups, phosphine groups, phosphonium groups, phosphate groups, cyano groups, nitrile groups, mercapto groups, nitroso groups, halogen atoms, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfide groups, sulfoxide groups, phosphine groups, phosphonium groups, phosphate groups, cyano groups, nitrile groups, mercapto groups, nitroso groups, halogen atoms, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof. Examples of suitable porphines include (1) 2,3,7,8,12,13,17,18-octaethyl-21H,23H-porphine (Aldrich 25,240-9), of the formula

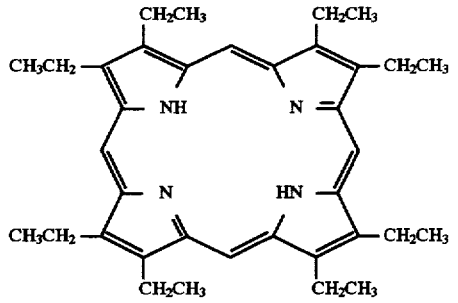

(2) dimethyl 3,7,12,17-tetramethyl-21H,23H-porphine-2,18-dipropionate (Aldrich 25,294-8), of the formula

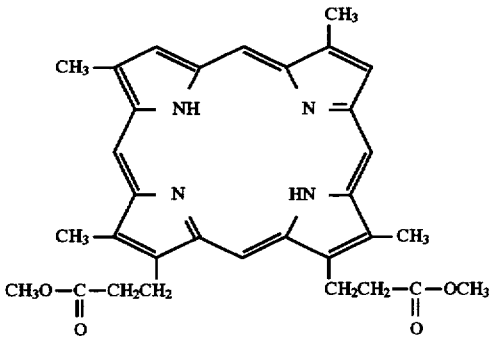

(3) dimethyl 7,12-diacetyl-3,8,13,17-tetramethyl-21H,23H-porphine-2,18-dipropionate (Aldrich 25,290-5), of the formula

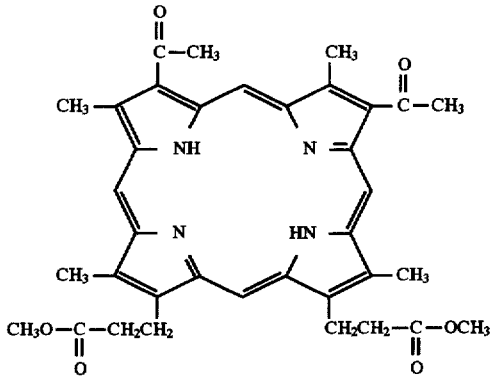

(4) 8,3-divinyl-3,7,12,17-tetramethyl-21H,23H-porphine-2,18-dipropionic acid, disodium salt (Aldrich 25,838-5), of the formula

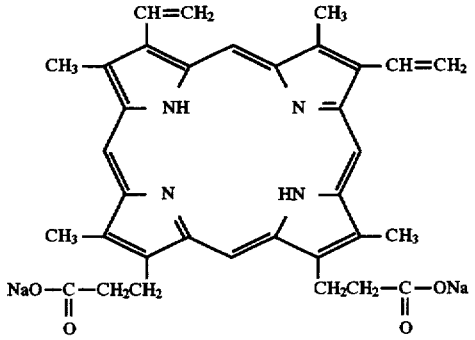

(5) 5,10,15,20-tetraphenyl-21H,23H-porphine (Aldrich 16,099-7), of the formula

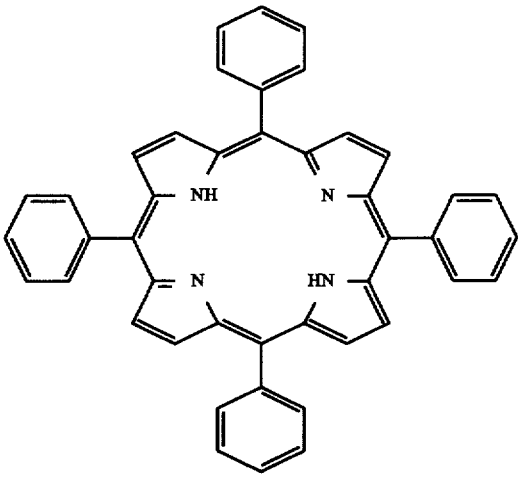

(6) 5,10,15,20-tetrakis(4-methoxyphenyl)-21H,23H-porphine (Aldrich 25,288-3), of the formula

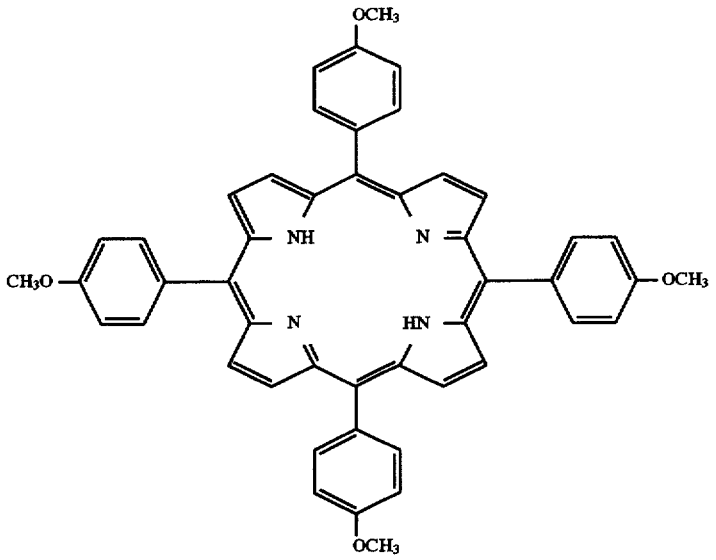
(7) 5,10,15-20-tetrakis[4-(trimethylamino)phenyl]-21H, 23H-porphine tetra-p-tosylate salt (Aldrich 30,678-9), of the formula
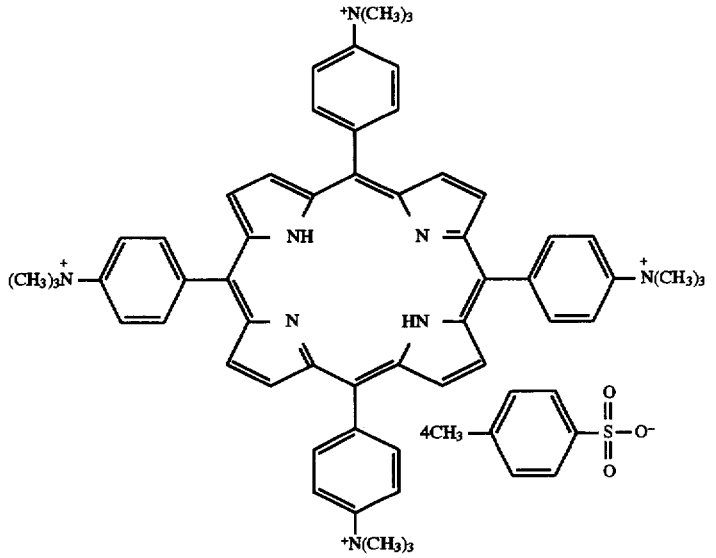
(8) 5,10,15,20-tetra(4-pyridyl)-21H,23H -porphine (Aldrich 25,761-3), of the formula

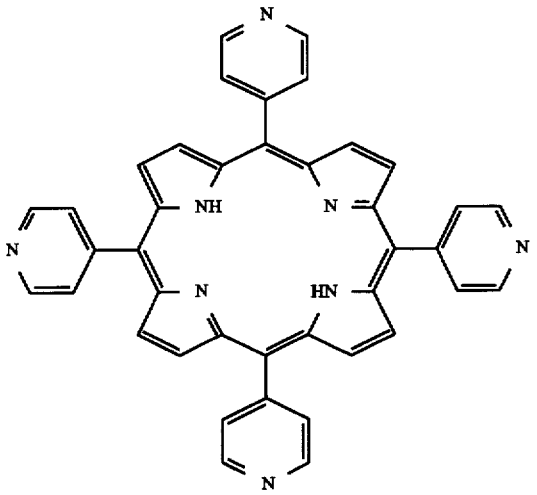

(9) 5,10,15,20-tetrakis(1-methyl-4-pyridyl)-21H,23H-porphine, tetra-p-tosylate salt) (Aldrich 32,249-7), of the formula

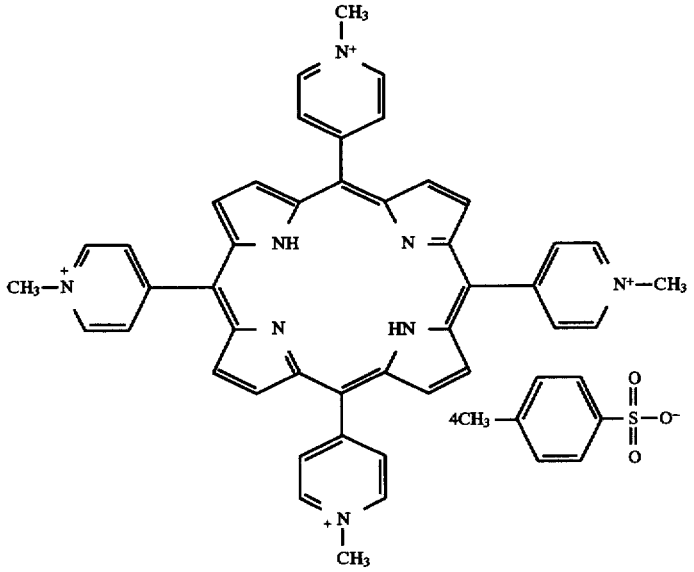

and the like. Mixtures of any two or more of the above materials can also be employed.

The macrocycle, porphine, or mixture thereof is present in any effective amount relative to the substrate. Typically, the macrocycle, porphine, or mixture thereof is present in an amount of from about 1 to about 50 percent by weight of the substrate, preferably from about 5 to about 30 percent by weight of the substrate, although the amount can be outside this range. The amount can also be expressed in terms of the weight of the macrocycle, porphine, or mixture thereof per unit area of substrate. Typically, the macrocycle, porphine, or mixture thereof is present in an amount of from about 0.8 to about 40 grams per square meter of the substrate surface to which it is applied, and preferably from about 4 to about 24 grams per square meter of the substrate surface to which it is applied, although the amount can be outside these ranges. While not required, generally the macrocycle, porphine, or mixture thereof is applied to the entire surface of either one or both sides of the substrate.

When the macrocycle, porphine, or mixture thereof is applied to the substrate as a coating, the coatings employed for the recording sheets of the present invention can include an optional binder in addition to the macrocycle, porphine, or mixture thereof. Examples of suitable binder polymers include (a) hydrophilic polysaccharides and their modifications, such as (1) starch (such as starch SLS-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methocel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC7HOF, available from Hercules Chemical Company), (20) gum arabic (such as #G9752, available from Sigma Chemical Company), (21 ) carrageenan (such as #C1013 available from Sigma Chemical Company), (22) Karaya gum (such as #G0503, available from Sigma Chemical Company), (23) xanthan (such as Keltrol-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly(vinyl phosphate) (such as #4391 available from Poly Sciences Inc.), (3) poly(vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as

#371, available from Scientific Polymer Products), (6) poly (vinylamine) (such as #1562, available from Poly Sciences Inc.), (7) poly(vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573, available from Poly Sciences Inc.), and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly(2-acrylamide-2-methyl propane sulfonic acid) (such as #175 available from Scientific Polymer Products), (2) poly(N,N-dimethyl-3,5-dimethylene piperidinium chloride) (such as #401, available from Scientific Polymer Products), and (3) poly(methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals, (4) quaternary acrylic copolymer latexes, particularly those of the formula

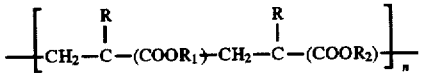

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as FMA from Monsanto Chemical Company), (4) bubutadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly(acrylamide) (such as #02806, available from Poly Sciences Inc.), (2) acrylamide-acrylic acid copolymers (such as #04652, #02220, and #18545, available from Poly Sciences Inc.), and (3) poly(N,N-dimethyl acrylamide) (such as #004590, available from Poly Sciences Inc.); and (h) poly(alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly(ethylene imine), wherein alkyl has one (methoxylated), two (ethoxylated), three (propoxylated), or four (butoxylated) carbon atoms (such as ethoxylated poly(ethylene imine #636, available from Scientific Polymer Products); (I) poly (alkylene oxides) such as poly(ethylene oxide) (POLY OX-WSRN-3000 available from Union Carbide Company); (j) other polymers such as poly(2-ethyl-2-oxazoline) (#37, 397-4 available from Aldrich Chemical Company), poly (dibenzo 18-crown-6)-co-formaldehyde (#35,925-4 available from Aldrich Chemical Company), 1-[N[Poly(3-allyloxy-2-hydroxypropyl)]-2-aminoethyl]-2-imidazolidinone (#41,026-8 available from Aldrich Chemical Company), poly[N,N'-bis(2,2,6,6-tetramethyl-4-piperidinyl)-1,6-hexanediamine-co-dichloro-6-morpholino-1,3,5-triazine] (#41,324-0 available from Aldrich Chemical Company); (k) alcohol and acetone soluble polymers, such as polyacrylic acid, including #598, #599, #600, #413, available from Scientific Polymer Products, Poly (hydroxyalkyl methacrylates), wherein alkyl has from 1 to about 18 carbon atoms, including methyl, ethyl, propyl, butyl, hexadecyl, and the like, including poly(2-hydroxyethylmethacrylate), such as #414, #815, available from Scientific Polymer Products, and poly (hydroxypropylmethacrylate), such as #232 available from Scientific Polymer Products, poly(hydroxyalkylacrylates), wherein alkyl is methyl, ethyl, or propyl, including poly(2-hydroxyethyl acrylate), such as #850, available from Scientific Polymer Products, and poly(hydroxypropyl acrylate), such as #851, available from Scientific Polymer Products, vinyl alcohol-vinyl acetate copolymers, including those with a vinyl alcohol content of about 9 percent by weight, such as #379, available from Scientific Polymer Products, vinyl alcohol-vinyl butyral copolymers, including those with a vinyl alcohol content of about 19.5 percent by weight, such as #381, available from Scientific Polymer Products, alkyl cellulose or aryl cellulose, wherein alkyl is methyl, ethyl, propyl, or butyl and aryl is phenyl or the like, including ethyl cellulose such as Ethocel N-22, available from Hercules Chemical Company, poly(vinylacetate), such as #346, #347, available from Scientific Polymer Products, and the like; ketone soluble polymers, such as those polymers soluble in acetone, including hydroxyalicyl cellulose acrylates and hydroxyaryl cellulose acrylates, wherein alkyl is methyl, ethyl, propyl, or butyl and aryl is phenyl or the like, including hydroxyethyl cellulose acrylate, such as #8630, available from Monomer-Polymer and Dajac Laboratories Inc., hydroxyalicyl cellulose methacrylates and hydroxyaryl cellulose methacrylates, wherein alicyl is methyl, ethyl, propyl, or butyl and aryl is phenyl or the like, including hydroxyethyl cellulose methacrylate, such as #8631, available from Monomer-Polymer and Dajac Laboratories Inc., cellulose-acrylamide adducts, such as #8959, #8960, #8961, #8962, available from Monomer-Polymer and Dajac Laboratories, Inc., poly(vinyl butyral), such as #043, #511, #507, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, poly(α-methylstyrene), such as #309, available from Scientific Polymer Products, styrene-butadiene copolymers, such as Kraton G-1652, Kraton DX-1150, and Kraton elastomer (such as D1107, G-1657, G-1657/FG1901, D-1101, FG1901, available from Shell Corporation), styrene-butylmethacrylate copolymers, such as #595, available from Scientific Polymer Products, vinyl chloride-vinylacetate-vinyl alcohol terpolymers, such as #428, available from Scientific Polymer Products, chlorinated solvent soluble polymers, such as poly(p-phenylene ether-sulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, poly carbonates, such as #035, available from Scientific Polymer Products, α-methylstyrene-dimethylsiloxane block copolymers, such as PS 0965, available from Petrarch Systems, dimethyl siloxane-bisphenol A carbonate block copolymers, such as $PSO_{99}$, available from Petrarch Systems, poly(2,6-dimethyl p-phenylene oxide), such as #126, available from Scientific Polymer Products, poly(2,4,6-tribromostyrene), such as #166, available from Scientific Polymer Products, ethylene-maleic anhydride copolymers, such as #2308, available from Polysciences, Inc., also available as EMA from Monsanto Chemical Co., and the like, as well as blends or mixtures of any of the above with polysaccharides and latexes being particularly preferred because of their availability and applicability to the substrate. Any mixtures of the above ingredients in any relative amounts can be employed.

If present, the binder can be present within the coating in any effective amount; typically the binder and the additive material are present in relative amounts of from about 10 percent by weight binder and about 90 percent by weight additive material to about 99 percent by weight binder and about 1 percent by weight additive material, although the relative amounts can be outside of this range.

In addition, the coating of the recording sheets for the present invention can contain optional filler components. Fillers can be present in any effective amount, and if present, typically are present in amounts of from about 1 to about 60 percent by weight of the coating composition. Examples of filler components include colloidal silicas, such as Syloid 74, available from Grace Company (preferably present, in one embodiment, in an amount of about 20 weight percent), titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira. O. Y, zinc oxide, such as Zoco Fax 183, available from Zo Chem, blends of zinc sulfide with barium sulfate, such as Lithopane, available from Schteben Company, and the like, as well as mixtures thereof. Brightener fillers can enhance color mixing and assist in improving print-through in recording sheets of the present invention.

Further, the coating of the recording sheets for the present invention can contain optional antistatic components. Antistatic components can be present in any effective amount, and if present, typically are present in amounts of from about 0.5 to about 5.0 percent by weight of the coating composition. Examples of antistatic components include both anionic and cationic materials. Examples of anionic antistatic components include monoester sulfosuccinates, such as those of the general formula

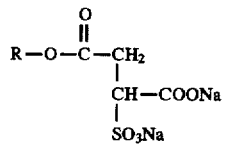

wherein R represents an alkanolamide or ethoxylated alcohol, diester sulfosuccinates, such as those of the general formula

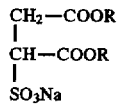

wherein R represents an alkyl group, and sulfosuccinamates, such as those of the general formula

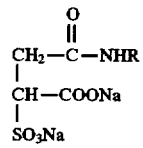

wherein R represents an alkyl group, 811 commercially available from Alkaril Chemicals as, for example, Alkasurf SS-L7DE, Alkssurf SS-L-HE, Alkssurf SS-OA-HE, Alkasurf SS-L9ME, Alkasurf SS-DA4-HE, Alkasurf SS-1B-45, Alkasurf SS-MA-80, Alkasurf SS-NO, Alkasurf SS-0-40, alkasurf SS-0-60PG, Alkasurf SS-0-70PG, Alkasurf SS-0-75, Alkasurf SS-TA, and the like. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, particularly those of the formula

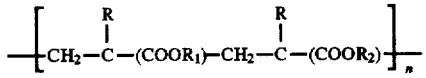

wherein n is a number of from about 10 to about 100, and preferably about 50, R is hydrogen or methyl, $R_1$ is hydrogen, an alkyl group, or an aryl group, and $R_2$ is $N^+(CH_3)_3^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like.

Also suitable as antistatic agents are quaternary choline halides. Examples of suitable quaternary choline halides include (1) choline chloride [(2-hydroxyethyl)trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl)trimethyl ammonium chloride[bromo choline chloride] $BrCH_2CH_2N(CH_3)_3Br$ (Aldrich 11,719-6); (9) (2-chloro ethyl)trimethyl ammonium chloride [chloro choline chloride) $ClCH_2CH_2N(CH_3)_3Cl$ (Aldrich 23,443-5); (10) (3-carboxy propyl)trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$ (Aldrich B10,425-6); (13) S-propionyl thiocholine iodide $C_2H_5COSCH_2CH_2N(CH_3)I$ (Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[—(CH_2)_3COOCH_2CH_2N(CH_3)_3Cl]_2$ (Aldrich 86,204-5) and suberyl dicholine diiodide $[—(CH_2)_3COOCH_2CH_2N(CH_3)_3I]_2$ (Aldrich 86,211-8); and the like, as well as mixtures thereof.

Additional examples of materials suitable as antistatic components include those disclosed in copending application Ser. No. 08/034,917 and in U.S. Pat. Nos. 5,314,747, 5,320,902, 5,457,486, and 5,441,795, the disclosures of each of which are totally incorporated herein by reference.

The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets for the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio)benzothiazole (Busan 30WB, 72WB, available from Buckman Laboratories Inc.); (3) methylene bis(thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1, 3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis(trichloromethyl)sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio)benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio)benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio)benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazoline-3-one (25 percent by weight), (available as AMERSTAT 250 from Drew Industrial Division; NALCON 7647, from NALCO Chemical Company; Kathon L. Y., from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly(oxyethylene (dimethylamino)-ethylene(dimethylamino)ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl)sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

The coating containing the macrocycle, porphine, or mixture thereof is present on the substrate of the recording sheet of the present invention in any effective thickness. Typically, the total thickness of the coating layer (on each surface, when both sides of the substrate are coated) is from about 1 to about 25 microns and preferably from about 5 to about 10 microns, although the thickness can be outside of these ranges.

In one embodiment of the present invention, the additive material is admixed with a binder (as well as with any additional optional components) and the coating mixture is applied to the substrate, resulting in a recording sheet having at most one coating on each major surface thereof. In another embodiment of the present invention, two or more layers can be coated onto one or both major surfaces of the substrate. For example, in one embodiment, the substrate is first coated with a layer containing a hydrophilic polymer, and onto the first coating is coated a second coating containing the additive material as well as any optional binder, filler, antistatic agent, biocide, or other optional ingredients. In this embodiment, the typical thickness of the first layer (on each side, when both surfaces of the substrate are coated) is from about 1 to about 25 microns and preferably from about 5 to about 10 microns, although the thickness can be outside of these ranges. Typically, the thickness of the second layer (on each side, when both surfaces of the substrate are coated) is from about 1 to about 10 microns and preferably from about 1 to about 5 microns, although the thickness can be outside of these ranges.

The coating or coatings can be applied to the substrate by any suitable technique. For example, the layer coatings can be applied by a number of known techniques, such as size press treatment, dip coating, reverse roll coating, extrusion coating, or the like. For example, the coating can be applied with a KRK size press (Kumagai Riki Kogyo Co., Ltd., Nerima, Tokyo, Japan) by dip coating and can be applied by solvent extrusion on a Faustel Coater. The KRK size press is a lab size press that simulates a commercial size press. This size press is normally sheet fed, whereas a commercial size press typically employs a continuous web. On the KRK size press, the substrate sheet is taped by one end to the carrier mechanism plate. The speed of the test and the roll pressures are set, and the coating solution is poured into the solution tank. A 4 liter stainless steel beaker is situated underneath for retaining the solution overflow. The coating solution is cycled once through the system (without moving the substrate sheet) to wet the surface of the rolls and then returned to the feed tank, where it is cycled a second time. While the rolls are being "wetted", the sheet is fed through the sizing rolls by pressing the carrier mechanism start button. The coated sheet is then removed from the carrier mechanism plate and is placed on a 12 inch by 40 inch sheet of 750 micron thick Teflon for support and is dried on the Dynamic Former drying drum and held under restraint to prevent shrinkage. The drying temperature is approximately 105° C. This method of coating treats both sides of the substrate simultaneously.

In dip coating, a web of the material to be coated is transported below the surface of the liquid coating composition by a single roll in such a manner that the exposed site is saturated, followed by removal of any excess coating by the squeeze rolls and drying at 100° C. in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer at 100° C.

Recording sheets of the present invention can be employed in ink jet printing processes. One embodiment of the present invention is directed to a process which comprises applying an aqueous recording liquid to a recording sheet of the present invention in an imagewise pattern. Another embodiment of the present invention is directed to a printing process which comprises (1) incorporating into an ink jet printing apparatus containing an aqueous ink a recording sheet of the present invention, and (2) causing droplets of the ink to be ejected in an imagewise pattern onto the recording sheet, thereby generating images on the recording sheet. Ink jet printing processes are well known, and are described in, for example, U.S. Pat. Nos. 4,601,777, 4,251,824, 4,410,899, 4,412,224, and 4,532,530, the disclosures of each of which are totally incorporated herein by reference. In a particularly preferred embodiment, the printing apparatus employs a thermal ink jet process wherein the ink in the nozzles is selectively heated in an imagewise pattern, thereby causing droplets of the ink to be ejected in imagewise pattern. In another preferred embodiment, the substrate is printed with an aqueous ink and thereafter the printed substrate is exposed to microwave radiation, thereby drying the ink on the sheet. Printing processes of this nature are disclosed in, for example, U.S. Pat. No. 5,220,346, the disclosure of which is totally incorporated herein by reference.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

The recording sheets of the present invention enable production of excellent quality images when imaged with aqueous inks. The resulting images have good or excellent optical density, solid area optical density, dry times, and line edge quality, and exhibit little or no intercolor bleed.

Recording sheets of the present invention exhibit reduced curl upon being printed with aqueous inks, particularly in situations wherein the ink image is dried by exposure to microwave radiation. Generally, the term "curl" refers to the distance between the base line of the arc formed by recording sheet when viewed in cross-section across its width (or shorter dimension—for example, 8.5 inches in an 8.5×11 inch sheet, as opposed to length, or longer dimension—for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Transparency sheets were prepared as follows. Blends of 70 percent by weight hydroxypropyl methyl cellulose (K35LV, obtained from Dow Chemical Co.) and 30 percent by weight of various additive compositions, each obtained from Aldrich Chemical Co., were prepared by mixing 56 grams of hydroxypropyl methyl cellulose and 24 grams of the additive composition in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. For comparison purposes, a transparency sheet was also prepared in which the coating consisted of 100 percent by weight hydroxypropyl methyl cellulose and contained no additive composition.

The transparency sheets thus prepared were incorporated into a Hewlett-Packard 500-C color ink jet printer containing inks of the following compositions:

Cyan: 15.785 percent by weight sulfolane, 10.0 percent by weight butyl carbitol, 2.0 percent by weight ammonium bromide, 2.0 percent by weight N-cyclohexylpyrrolidinone obtained from Aldrich Chemical company, 0.5 percent by weight tris (hydroxymethyl)aminomethane obtained from Aldrich Chemical Company, 0.35 percent by weight EDTA (ethylenediamine tetra acetic acid) obtained from Aldrich Chemical Company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 35 percent by weight Projet Cyan 1 dye, obtained from ICI, 34.285 percent by weight deionized water.

Magenta: 15.785 percent by weight sulfolane, 10.0 percent by weight butyl carbitol, 2.0 percent by weight ammonium bromide, 2.0 percent by weight N-cyclohexylpyrrolidinone obtained from Aldrich Chemical company, 0.5 percent by weight tris (hydroxymethyl)aminomethane obtained from Aldrich Chemical Company, 0.35 percent by weight EDTA (ethylenediamine tetra acetic acid) obtained from Aldrich Chemical Company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 25 percent by weight Projet magenta 1T dye, obtained from ICI, 4.3 percent by weight Acid Red 52 obtained from Tricon Colors, 39.985 percent by weight deionized water.

Yellow: 15.785 percent by weight sulfolane, 10.0 percent by weight butyl carbitol, 2.0 percent by weight ammonium bromide, 2.0 percent by weight N-cyclohexylpyrrolidinone obtained from Aldrich Chemical Company, 0.5 percent by weight tris (hydroxymethyl)aminomethane obtained from Aldrich Chemical company, 0.35 percent by weight EDTA (ethylenediamine tetra acetic acid) obtained from Aldrich Chemical Company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 27.0 percent by weight Projet yellow 1G dye, obtained from ICI, 20.0 percent by weight Acid Yellow 17 obtained from Tricon Colors, 22.285 percent by weight deionized water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 Watts output power at 2450 MHz frequency. The black images were "process black" (i.e., formed by superimposition of cyan, magenta, and yellow images). The drying times and optical densities for the resulting images were as follows:

| | Drying Time (seconds) | | | | Optical Density | | | |
|---|---|---|---|---|---|---|---|---|
| Additive | black | cyan | magenta | yellow | black | cyan | magenta | yellow |
| none | 30 | 20 | 30 | 20 | 2.30 | 1.97 | 1.45 | 0.89 |
| 18-crown-6 | 15 | 10 | 20 | 15 | 2.10 | 2.00 | 1.45 | 0.95 |
| 1-aza-18-crown-6 | 15 | 15 | 15 | 15 | 2.10 | 2.13 | 1.41 | 0.96 |
| hexacyclen trisulphate | 10 | 15 | 20 | 10 | 2.05 | 1.85 | 1.50 | 0.90 |
| 1,5,9,13-tetrathiacyclodecane-3,11-diol | 10 | 20 | 20 | 10 | 1.90 | 1.80 | 1.40 | 0.87 |

As the results indicate, the drying times of the process black images were faster in the presence of the additives than in their absence, and the drying times of the cyan, magenta, and yellow images were also improved in most instances. In addition, the optical densities of all images were also acceptable and in some instances were improved.

EXAMPLE II

Transparency sheets were prepared as described in Example I with the exception that the coating contained blends of 90 percent by weight hydroxypropyl methyl cellulose and 10 percent by weight of various additive compositions obtained from Aldrich Chemical Co., prepared by mixing 72 grams of hydroxypropyl methyl cellulose and 8 grams of the additive composition.

The transparency sheets thus prepared were incorporated into a Hewlett-Packard 500-C color ink jet printer and images were generated as described in Example I. The drying times and optical densities for the resulting images were as follows:

| | Drying Time (minutes) | | | | Optical Density | | | |
|---|---|---|---|---|---|---|---|---|
| Additive | black | cyan | ma-genta | yel-low | black | cyan | ma-genta | yel-low |
| none | 10 | 5 | 5 | 2 | 2.95 | 2.10 | 1.37 | 0.99 |
| 12-crown-4 | 7 | 3 | 3 | 1.5 | 1.85 | 1.97 | 1.30 | 0.85 |
| 2-(hydroxy-methyl)15-crown-5 | 4 | 2.5 | 2.5 | 1 | 1.90 | 2.20 | 1.42 | 0.88 |
| 1,4,8,11-tetraaza-cyclotetra-decane-5,7-dione | 3.5 | 2 | 3 | 1.5 | 1.88 | 1.97 | 1.45 | 0.80 |

As the results indicate, the drying times of the transparencies containing the additives were generally equivalent to or faster than the drying times of the transparency containing no additives. In addition, the optical densities of the images on the transparencies containing the additives were acceptable and in some instances improved compared to those on the transparencies containing no additives.

EXAMPLE III

Transparency sheets were prepared as described in Example I with the exception that the coating contained blends of 54 percent by weight hydroxypropyl methyl cellulose, 36 percent by weight poly(ethylene oxide) (POLY OX WSRN-3000, obtained from Union Carbide Corp., and 10 percent by weight of various additive compositions obtained from Aldrich Chemical Co., prepared by mixing 43.2 grams of hydroxypropyl methyl cellulose, 28.8 grams of poly(ethylene oxide), and 8 grams of the additive composition. For comparison purposes, a transparency sheet was also prepared in which the coating consisted of 60 percent by weight hydroxypropyl methyl cellulose and 40 percent by weight poly(ethylene oxide) and contained no additive composition.

The transparency sheets thus prepared were incorporated into a Hewlett-Packard 500-C color ink jet printer and images were generated as described in Example I. The drying times and optical densities for the resulting images were as follows:

| | Drying Time (minutes) | | | | Optical Density | | | |
|---|---|---|---|---|---|---|---|---|
| Additive | black | cyan | ma-genta | yel-low | black | cyan | ma-genta | yel-low |
| none | 15 | 10 | 10 | 10 | 1.40 | 1.46 | 1.34 | 1.02 |
| 2-amino-ethyl-15-crown-5 | 8 | 5 | 4.5 | 5 | 1.33 | 1.38 | 1.25 | 0.85 |
| hexacyclen trisulphate | 7 | 4.5 | 4 | 4 | 1.70 | 1.30 | 1.37 | 0.85 |
| 1,5,9,13,17,21-hexa-thiacyclo-tetracosane-3,11,19-triol | 6 | 4 | 4 | 3 | 1.50 | 1.45 | 1.20 | 0.95 |

As the results indicate, the drying times of the transparencies containing the additives were generally faster than the drying times of the transparency containing no additives. In addition, the optical densities of the images on the transparencies containing the additives were acceptable in all instances.

EXAMPLE IV

Transparency sheets were prepared as follows. Blends of 65 percent by weight hydroxypropyl methyl cellulose (K35LV, obtained from Dow Chemical Co.), 35 percent by weight poly(ethylene oxide) (POLY OX WSRN-3000, obtained from Union Carbide Corp., were prepared by mixing 65.0 grams of hydroxypropyl methyl cellulose and 35.0 grams of poly(ethylene oxide) in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5×11 inches) in a thickness of 100 microns. Subsequent to air drying at 25° C. for 3 hours followed by oven drying at 100° C. for 10 minutes and monitoring the difference in weight prior to and subsequent to coating, the dried coated sheets were each coated with 1 gram, 10 microns in thickness, on each surface (2 grams total coating weight for 2-sided transparency) of the substrate. These coated sheets were subsequently further coated with a 5 percent by weight solution of 1,4,7,10,13-pentathiacyclopentadecane (Aldrich 28,134-4) in acetone in a thickness of 2 microns each side. For comparison purposes, a transparency sheet was also prepared in which the coating consisted of 65 percent by weight hydroxypropyl methyl cellulose and 35 percent by weight poly(ethylene oxide) and was over coated with solvent acetone alone without any additive.

The transparency sheets thus prepared were incorporated into a Hewlett-Packard 500-C color ink jet printer and images were generated as described in Example I. The images thus obtained were analyzed for optical density and lightfastness. The black images were "process black" (i.e., formed by superimposition of cyan, magenta, and yellow images). The optical density of images on recording sheets containing no additive were measured to be 1.46 (cyan), 1.35 (magenta), 1.00 (yellow), 1.50 (black) before exposure to light and 1.25 (cyan), 1.15 (magenta), 0.90 (yellow), 1.30 (black) after exposure to light in a Mark V Lightfastness Tester (available from Microscal Ltd., London, UK) for a period of 24 hours (equivalent to 30 days of sunshine). The optical density of images on recording sheets containing 1,4,7,10,13-pentathiacyclopentadecane as the additive were measured to be 1.65 (cyan), 1.45 (magenta), 1.10 (yellow), 1.65 (black) before exposure to light and 1.60 (cyan), 1.40 (magenta), 1.05 (yellow), 1.55 (black) after exposure to light for the same period of time. These results show that the presence of 1,4,7,10,13-pentathiacyclopentadecane on the surface of the recording sheets enhanced the optical density and protected the images from fading.

EXAMPLE V

Twenty recording sheets were prepared as described in Example IV except that the overcoat (second coating) consisted of a blend of 50 percent by weight vinylalcohol-vinylacetate copolymer (#379 available from Scientific Polymer Products Inc.) and 50 percent by weight 1,4,7,10,13-pentathiacyclopentadecane (Aldrich 28,134-4) and the coating was coated from a 2.5 percent by weight solution in acetone in a dry thickness of 3 microns. For comparison purposes a few recording sheets were also prepared with an overcoat (second coating) consisting of the vinylalcohol-vinylacetate copolymer alone without the additive.

The transparency sheets thus prepared were incorporated into a Hewlett-Packard 500-C color ink jet printer and images were generated as described in Example I. The images thus obtained were analyzed for optical density and lightfastness. The black images were "process black" (i.e., formed by superimposition of cyan, magenta, and yellow images). The optical density of images on recording sheets containing no additive were measured to be 1.40 (cyan), 1.30 (magenta), 0.95 (yellow), 1.40 (black) before exposure to light and 1.25 (cyan), 1.10 (magenta), 0.85 (yellow), 1.30 (black) after exposure to light in a Mark V Lightfastness Tester (available from Microscal Ltd., London, UK) for a period of 24 hours (equivalent to 30 days of sunshine). The optical density of images on recording sheets containing the blend of vinylalcohol-vinylacetate copolymer and 1,4,7,10,13-pentathiacyclopentadecane as the additive were measured to be 1.60 (cyan), 1.41 (magenta), 1.07 (yellow), 1.60 (black) before exposure to light and 1.56 (cyan), 1.37 (magenta), 1.00 (yellow), 1.55 (black) after exposure to light for the same period of time. These results show that the presence of the blend of vinylalcohol-vinylacetate copolymer and 1,4,7,10,13-pentathiacyclopentadecane on the surface of the recording sheets enhanced the optical density and protected the images from fading.

Other embodiments and modifications of the present invention may occur to those skilled in the art subsequent to a review of the information presented herein; these embodiments and modifications, as well as equivalents thereof, are also included within the scope of this invention.

What is claimed is:

1. A recording sheet which comprises (a) a paper or transparent polymeric material substrate, and (b) an image receiving coating situated on at least one surface of the substrate, said coating containing an additive selected from the group consisting of macrocycles and mixtures thereof, said image receiving coating being suitable for receiving images of an aqueous ink.

2. An imaged recording sheet which comprises a substrate and an image receiving coating situated on at least one surface of the substrate, said coating containing an additive selected from the group consisting of macrocycles, porphines, and mixtures thereof, said image receiving coating containing an image applied from an aqueous ink.

3. A recording sheet according to claim 2 wherein the substrate is transparent.

4. A recording sheet according to claim 2 wherein the substrate is paper.

5. A recording sheet according to claim 2 wherein the additive material is of the formula

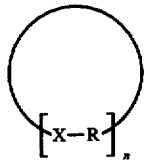

wherein n is an integer of from 3 to 20, wherein each X, independently of the others, is an oxygen atom, a sulfur atom, or an amine group, and wherein each R, independently of the others, is an alkylene group or a substituted alkylene group with two, three, four, or five carbon atoms.

6. A recording sheet according to claim 2 wherein the additive material is of the formula

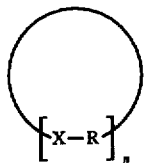

wherein n is an integer of from 3 to 20, wherein each X, independently of the others, is an oxygen atom, a sulfur atom, or a group of the formula —NQ—, wherein Q is selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein each R, independently of the others, is

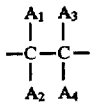

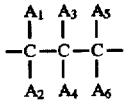

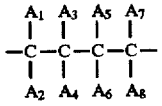

or

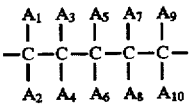

wherein $A_1$, $A_2$, $A_3$, $A_4$, $A_5$, $A_6$, $A_7$, $A_8$, $A_9$, and $A_{10}$ each, independently of the others, is selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of Q, $A_1$, $A_2$, $A_3$, $A_4$, $A_5$, $A_6$, $A_7$, $A_8$, $A_9$, and $A_{10}$ can be joined together to form a ring, and wherein double bonds may exist between ring carbon atoms and atoms in Q, $A_1$, $A_2$, $A_3$, $A_4$, $A_5A_6$, $A_7$, $A_8$, $A_9$, and $A_{10}$.

7. A recording sheet according to claim 2 wherein the additive material is a crown ether or an oxa-cryptand.

8. A recording sheet according to claim 2 wherein the additive material is selected from the group consisting of (1) 1,4,7,10-tetraoxacyclododecane (12-crown-4), (2)2-(hydroxyethyl)-12-crown-4, (3) 2-(aminoethyl)-12-crown-4, (4) benzo-12-crown-4, (5) 15-crown-5, (6) 2-(hydroxymethyl)-15-crown-5, (7) 2-(aminoethyl)-15-crown-5, (8) benzo-15-crown-5, (9) 4'-aminobenzo-15-crown-5, (10) 4'-formylbenzo-15-crown-5, (11) 4'-nitrobenzo-15-crown-5, (12) bis[(benzo-15-crown-5)-15-ylmethyl]pimelate, (13) 18-crown-6, (14) 2-(aminoethyl)-18 crown-6, (15) benzo-18 crown-6, (16) 4'-bromobenzo-18-crown-6, (17) di benzo-18-crown-6, (18) di-tert-butyldibenzo-18-crown-6, (19) cis-dicyclohexane-18 crown-6, (20) dibenzo-24-crown-8, (21) dicyclohexano-24-crown-8, (22) dibenzo-30-crown-10, and mixtures thereof.

9. A recording sheet according to claim 2 wherein the additive material is an oxaoaza crown ether or an oxa-aza cryptand.

10. A recording sheet according to claim 2 wherein the additive material is selected from the group consisting of (1) 1-aza-12-crown-4, (2) 1-aza-15-crown-5, (3) 1,4,10-trioxa-7,13-diazacyclopentadecane, (4) 4,7,13,18-tetraoxa-1,10-diazabicyclo[8.5.5]eicosane, (5) 4,7,13,16,21-pentaoxa-1,10-diazabicyclo[8.5.5]tricosane, (6) 1-azao 18-crown-6, (7) 1,4,10,13-tetraoxa-7, 16-diazacyclooctadecane, (8) N,N'-dibenzyl-1,4,10,13-tetraoxa-7,16-diazacyclooctadecane, (9) 4,7,13,16,21,24-hexaoxa-1,10-diazabicyclo[8.8.8]hexacosane, (10) 5,6-benzo-4,17,13,16,21,24-hexaoxa-1,10-diazabicyclo[8.8.8]hexacosane, and mixtures thereof.

11. A recording sheet according to claim 2 wherein the additive material is an aza crown ether or an aza cryptand.

12. A recording sheet according to claim 2 wherein the additive material is selected from the group consisting of (1) 1,4,7-triazacyclononane, (2) 1,5,9-triazacyclododecane, (3) cyclen, (4) 1,4,8,11-tetraazacyclotetradecane, (5) 1,4,8,11-tetramethyl-1,4,8,11-tetraazacyclotetradecane, (6) 1,4,8,11-tetraazacyclotetradecane-5,7-dione, (7) 1,4,8,12-tetraazacyclopentadecane, (8) hexacyclen trisulfate, (9) hexamethylhexacyclen, and mixtures thereof.

13. A recording sheet according to claim 2 wherein the additive material is a thia crown ether or a thia cryptand.

14. A recording sheet according to claim 2 wherein the additive material is selected from the group consisting of (1) 1,4,7-trithiacyclodecane, (2) 1,4,7-trithiacyclononane, (3) 1,4,7,10-tetrathiacyclododecane, (4) 3,609,14-tetrathiabicyclo[9.2.1]tetradeca-11,13-diene, (5) 1,4,8,1-tetrathiacyclotetradecane, (6) 1,5,9,13-tetrathiocyclohexadecane, (7) 1,5,9,13-tetrathiacyclohexadecane-3,11-diol, (8) 1,4,7,10,13-pentathiacyclopentadecane, (9) 1,4,7,10,13,16-hexathiacyclooctadecane, (10) 1,5,9,13,17,21-hexathiacyclotetracosane-3,11,19-triol, (11) 1,4,7,10,13,16,19,22-octathiacyclotetracosane, (12) 1,4,8,11,15,18,22,25-octathiacyclooctacosane, (13) 1,4,7,10,13,16,19,22,25-nonathiacycloheptacosane, and mixtures thereof.

15. A recording sheet according to claim 2 wherein the additive material is selected from the group consisting of porphines.

16. A recording sheet according to claim 2 wherein the additive material is selected from the group consisting of (1) 2,3,7,8,12,13,17,18-octaethyl-21H,23H-porphine, (2) dimethyl 3,7,12,17-tetramethyl-21H,23H-porphine-2,18-dipropionate, (3) dimethyl 7,12-diacetyl-3,8,13,17-tetramethyl-21H,23H-porphine-2,18-dipropionate, (4) 8,3-divinyl-3,7,12,17-tetramethyl-21H,23H-porphine-2,18-dipropionic acid salt, (5) 5,10,15,20-tetraphenyl-21H,23H-porphine, (6) 5,10,15,20-tetrakis(4-methoxyphenyl)-21H,23H-porphine, (7) 5,10,15,20-tetrakis[4-(trimethylamino)phenyl]-21H,23H-porphine salt, (8) 5,10,15,20-tetra(4-pyridyl)-21H,23H-porphine, (9) 5,10,15,20-tetrakis(1-methyl-4-pyridyl)-21H,23H-porphine salt, and mixtures thereof.

17. A recording sheet according to claim 2 wherein the additive material is of the formula

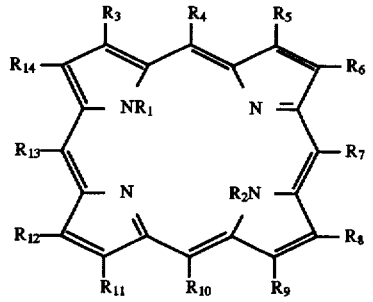

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, is selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring, and wherein double bonds may exist between ring carbon atoms and atoms in $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$.

18. A recording sheet according to claim 2 wherein the additive material is selected from the group consisting of 18-crown-6; 1-aza-18-crown-6; hexacyclen trisulphate; 1,5,9,13-tetrathiacyclodecane-3,11-diol; 12-crown-4; 2-(hydroxy-methyl)1,5-crown-5; 1,4,8,11-tetraazacyclotetradecane-5,7-dione; 2-aminoethyl-15-crown-5; 1,5,9,13,17,21-hexathiacyclotetracosane-3,11,19-triol; 1,4,7,10,13-pentathiacyclopentadecane; and mixtures thereof.

19. A process which comprises applying an aqueous recording liquid in an imagewise pattern to a recording sheet which comprises a substrate and an image receiving coating situated on at least one surface of the substrate, said coating containing an additive selected from the group consisting of macrocycles, porphines, and mixtures thereof, said image receiving coating being suitable for receiving images of an aqueous ink.

20. A printing process which comprises (1) incorporating into an ink jet printing apparatus containing an aqueous ink a recording sheet which comprises a substrate and an image receiving coating situated on at least one surface of the substrate, said coating containing an additive selected from the group consisting of macrocycles, porphines, and mixtures thereof, said image receiving coating being suitable for receiving images of an aqueous ink, and (2) causing droplets of the ink to be ejected in an imagewise pattern onto the recording sheet, thereby generating images on the recording sheet.

21. A recording sheet consisting essentially of (a) a paper or transparent polymeric material substrate, (b) an image receiving coating situated on at least one surface of the substrate, said coating containing an additive selected from the group consisting of porphines and mixtures thereof, said image receiving coating being suitable for receiving images of an aqueous ink, (c) an optional binder, (d) an optional filler, (e) an optional antistatic agent, and (f) an optional biocide.

* * * * *